US006325189B1

(12) United States Patent
King et al.

(10) Patent No.: US 6,325,189 B1
(45) Date of Patent: Dec. 4, 2001

(54) HYBRID CONSTRUCTION LUGGAGE CASE

(75) Inventors: William L. King, Denver; Diane Mary Erickson, Aurora; Wendell Christopher Alexander, Jr., Thornton, all of CO (US)

(73) Assignee: Samsonite Corporation, Denver, CO (US)

( * ) Notice: Subject to any disclaimer, the term of this patent is extended or adjusted under 35 U.S.C. 154(b) by 0 days.

(21) Appl. No.: 09/490,400

(22) Filed: Jan. 24, 2000

Related U.S. Application Data

(60) Provisional application No. 60/117,180, filed on Jan. 25, 1999, now abandoned.

(51) Int. Cl.[7] ..... A45C 5/14; A45C 13/06; A45C 13/10

(52) U.S. Cl. ..... 190/119; 190/18 R; 190/18 A; 190/126; 190/903

(58) Field of Search ..... 190/26, 119, 903, 190/121, 126, 18 A, 18 R

(56) References Cited

U.S. PATENT DOCUMENTS

| | | | | |
|---|---|---|---|---|
| 2,249,841 | * | 7/1941 | Loos et al. | 190/119 |
| 2,716,473 | * | 8/1955 | Droutman | 190/119 |
| 3,812,939 | * | 5/1974 | Pelletier | 190/119 X |
| 4,261,448 | * | 4/1981 | Myers et al. | 190/27 X |
| 4,703,519 | * | 10/1987 | Krenzel | 190/119 X |
| 5,003,671 | * | 4/1991 | Seynhaeve | 190/118 X |
| 5,197,579 | * | 3/1993 | Bieber et al. | 190/18 A |
| 5,197,580 | * | 3/1993 | Berman et al. | 190/18 A X |
| 5,295,565 | * | 3/1994 | Latshaw | 190/18 A |
| 5,447,261 | * | 9/1995 | Mitomi et al. | 190/110 X |
| 5,924,533 | * | 7/1999 | Cnockaert et al. | 190/121 X |
| 6,035,982 | * | 3/2000 | Wei-Chih | 190/126 X |

FOREIGN PATENT DOCUMENTS

| | | | | |
|---|---|---|---|---|
| 2638950 | * | 5/1990 | (FR) | 190/119 |

* cited by examiner

*Primary Examiner*—Sue A. Weaver
(74) *Attorney, Agent, or Firm*—Gregory W. O'Connor

(57) ABSTRACT

A two-wheeled luggage cases 10 formed of substantially two parts, the base shell 24 of a generally one-piece molded plastic construction, the lid shell 30 of a composite construction primarily of textile fabric panels assembled to form a covering that provides an access to the interior of the case. Properly fitting a textile lid to the integrally molded sides of a base shell is difficult, especially if the case is large, and most especially where the lid shell is constructed at a location remote from where the lid and base shell are joined to integrate the two and form the overall luggage case. Accordingly, the luggage case has a body portion which comprises a generally one piece base shell defining an interior volume to contain the user's things, and a lid shell is affixed to the base shell, the lid shell being mostly formed of fabric materials, and having a peripheral edge portion and an access opening. An elongated extrusion 55 is sewn along a peripheral edge portion of the lid shell. An outwardly facing groove is molded into the base shell adjacent and parallel to its peripheral edge, and fasteners 40 are passed through the edge portion of the base shell and through the first elongated extrusion. Straps 32 attach to the base shell and extend perpendicular to the peripheral edge of the base shell to embrace the lid shell and help provide a strong connection between the lid and base shell.

12 Claims, 5 Drawing Sheets

HYBRID CONSTRUCTION LUGGAGE CASE

This Application claims benefit of Prov. No. 60/117,180 Jan. 25, 1999, now abandoned.

BACKGROUND OF THE INVENTION

1. Field of the Invention (Technical Field)

The present invention relates to luggage, particularly wheeled luggage, and specifically a stable, easily pushed or pulled, two-wheeled luggage case. More particularly, the present invention relates to luggage cases formed of substantially two parts, the first part of a generally one-piece molded plastic construction, the other of a composite construction primarily of textile fabric panels assembled to form a covering that includes an access lid to the interior of the first molded part.

2. Background Art

Generally, luggage cases fall into two basic categories of construction. The first, generally called "hardside", comprises luggage cases made of thermoplastic or composite materials forming a generally box shape, the sides of the box having a generally rigid, resilient construction. Such hardside cases are now generally made of thermoplastic materials, having large portions of the luggage case formed of one piece in an injection molding or vacuum forming process. Other hardside cases have been formed of paperboard or metal sheet materials held together with edge trim and corner hardware to form a box. These boxes, whether formed of parts or integrally, are generally comprised of a lid shell hinged to a base shell.

Another form of luggage construction incorporates large portions of the hardside construction together with almost equal shares of softside construction. This type of luggage is generally shown in U.S. Pat. No. 5,447,261 which published patent is hereby incorporated by reference. The '261 patent could be generally characterized as an upright style case having a handle 36 at one end of its elongated dimension and a pair of wheels 28 at the other end. This luggage case has a one-piece base box 12 integrally formed of plastics material. The other portion of the case is a bag or cover 16 which closes the opening 14 to the inside of the base box 12. The cover 16 is stapled or stitched to the upper edge of the box 12. A slide fastener runs around the perimeter of the joint between the overlapping portion of the cover 16 to permit access to the space defined by the lid 16 and the box 12.

However, Applicants have found that properly fitting a generally textile constructed lid to the integrally molded sides of a base shell is difficult. This is especially true with a large case, and most especially where the lid shell is constructed at a location remote from where the lid and base shell are joined to integrate the two and form the overall luggage case.

For example, sewing a textile lid or cover around the periphery of the walls of a molded base shell can create gaps and mismatches between the adjacent textile and molded portions. The foot of a typical sewing machine can cause the textile material to creep or walk ahead of the sewing operation, resulting in a large amount of textile material in the lid to accumulate or gather ahead of the stitch line. Also, even if the textile portion and the molded portions exactly dimensionally matched one another initially, this could change with humidity, especially if the textile portion was constructed of a polyamide or nylon textile materials. It is well know that nylon can take on moisture, causing the overall dimensions of the textile panels to grow a substantial amount.

The luggage case constructed in accordance with U.S. Pat. No. 5,447,261 is known to include slots arranged at right angles in the edge of the box 12 at each comer radius. These slots are suspected to permit the outside circumference of this edge portion of the box to compress slightly to accommodate the dimensional variations or differences between the box edge and the corresponding edge of the cover 16.

Also, the joint between the lid and base shell is quite critical to the overall strength of such a hybrid between textile construction and an integrally molded base construction. A luggage case can suffer from extremes of heat and cold, and is often severely abused during its useful life. The cavity defined inside the luggage case can be filled with the traveler's things will likely weigh many times the empty weight of the luggage case. This weight puts great stresses on the luggage case, called "burst" forces, which tend to split the case apart. It is well recognized that the joints or seams in a typical textile constructed luggage case can be the weak points with regard to resisting such burst forces. However, the joint between the generally rigid base shell in the hybrid case and the textile lid or cover may be even more vulnerable to bursting, since the differences in rigidities between the two case portions will cause a stress concentration at the joint.

Also, the peripheral joint between the rigid base shell and a textile lid shell presents an opportune location for carrying straps and fasteners. A construction which permits locating and attaching these auxiliary straps and handles would present an ideal integration of the lid and base shell and these points of attachment, while distributing the stress inherent in the use of these handles and straps into the joint construction.

SUMMARY OF THE INVENTION (DISCLOSURE OF THE INVENTION)

A primary object of the present invention is to provide a luggage case, preferably a wheeled luggage case, having a integrally formed base molded shell and a lid shell affixed thereto, the lid shell comprising a construction substantially of a textile material, and to provide a precise, versatile and strong joint between the base shell and lid shell.

Another object of the invention is to provide such a luggage case with carrying straps which use penetrating fasteners to attach the carrying straps to the joint formed between the lid and base shells.

Still another object of the invention is to provide a luggage case which includes additional cinch straps attached to the sides of the base shell, these straps continue across the lid shell at substantially a right angle to the joint between the lid and base shells.

It is a further object of the invention to provide a method of affixing a textile lid shell to a molded base shell such that, if necessary, the lid and base shell can be subsequently separated, for example, with one or the other portions of the luggage should ever have to be replaced or repaired.

Accordingly, provided is a luggage case having a body portion for containing a user's things, at least a pair of wheels and a handle for towing the case on the wheels. The body portion comprises a base shell primarily formed of a one-piece molded plastic outer unit having a bottom, peripheral walls extending up from the bottom to define an interior volume to contain the user's things, and a peripheral edge portion along the terminal edge of the peripheral walls. A lid shell is affixed to the base shell, the lid shell being mostly formed of relatively flexible fabric materials, and having a peripheral edge portion and means formed therethrough for permitting access to the interior volume. Means are provided for permanently affixing the peripheral edge portion of the lid shell to the peripheral edge of the base shell, the means for permanently affixing including a first elongated extrusion sewn along a peripheral edge portion of the lid shell, an outwardly facing groove molded into the base shell adjacent and parallel to the peripheral edge of the base shell, and fasteners passing through the edge portion of the base shell and through the first elongated extrusion.

Also provided is a luggage case having a body portion for containing a user's things, at least a pair of wheels and a handle for towing the case on the wheels, the body portion comprising a base shell primarily formed of a relatively rigid, one-piece molded plastic outer unit having a bottom, peripheral walls extending up from the bottom to define an interior volume to contain the user's things, and a peripheral edge portion along the terminal edge of the peripheral walls. A lid shell is affixed to the base shell, the lid shell being mostly formed of relatively flexible fabric materials, and having a peripheral edge portion and means formed therethrough for permitting access to the interior volume. Means for permanently affixing the peripheral edge portion of the lid shell to the peripheral edge of the base shell include penetrating fasteners passing through the peripheral edge portion of the base shell and the peripheral edge portion of the lid shell, a first length of flexible strap extending along the peripheral edge portion of the lid shell, the penetrating fasteners passing through the flexible strap, a second length of flexible strap wrapping at least partially around a wall of the base shell and at least partially around the lid shell, the second length of webbing crossing at substantially right angles to the first length of webbing.

A primary advantage of the present invention is that a luggage apparatus is provided that includes an attachment between the lid and base shell which permits a fairly strong connection between the lid and base shell, but yet permits the lid and base shell edges to be adjusted relative to one another prior to permanent fastening.

Another advantage of the invention is that a luggage apparatus is provided which has a connection between a molded base shell and a textile construction lid shell, the connection being such that it includes penetrating fasteners that pass through the joint between the lid and base shell and two additional carrying straps located directly over the joint between the lid and base shell.

Still another advantage of the invention is that a luggage apparatus is provided which includes fastening means for attaching the molded base shell to textile constructed lid shell, these fasteners include means for holding straps at various locations on the inside of the luggage case, the straps being advantageously used to hold the user's goods and keep such goods organized within the luggage case during travel.

Still another advantage of the invention is that the inventive luggage case uses a peripheral strap to firmly attach the fabric portion to the molded portion and uses at least one additional luggage strap firmly attached to the sides of the molded portion to further affix the fabric portion, yet controllably permit the fabric portion to expand to accommodate various volumes of the user's goods during travel.

BRIEF DESCRIPTION OF THE DRAWINGS

The accompanying drawings, which are incorporated into and form a part of the specification, illustrate an embodiment of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENT (BEST MODE FOR CARRYING OUT THE INVENTION)

Although the invention has been described in detail with particular reference to the preferred embodiment, other embodiments can achieve the same results. Variations and modifications of the present invention will be obvious to those skilled in the art and it is intended to cover in the appended claims all such modifications and equivalents. The entire disclosures of all references, applications, patents, and publications cited are hereby incorporated by reference.

Figure 1:
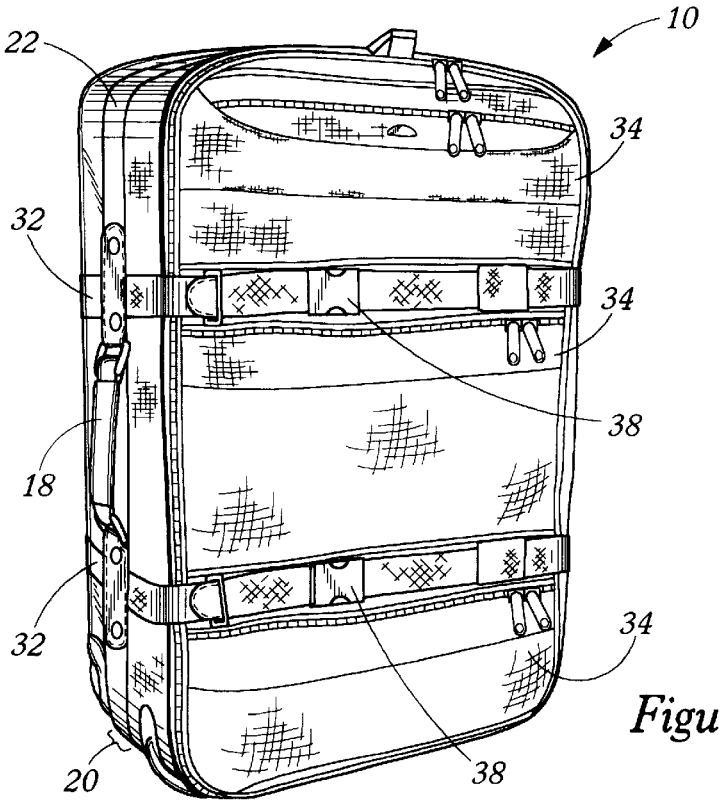
FIG. 1 shows the overall view of the preferred luggage in accordance with the instant invention, as viewed from the lid side of the luggage case.

Referring to the figures, the luggage case 10 according to the preferred embodiment is of the upright style, having two wheels 12 and 12 at one end and a handle 14 of a known mechanical type for towing the case on wheels at the other. As will be detailed, the case includes at least two other handles 16, 18 primarily used to carry the luggage case over obstacles and to help manipulate the luggage case into the trunks of automobiles and the holds of aircraft. The outside of the luggage case is dominated by a joint 20 defined by a first length of webbing 22 extending around the entire longitudinal periphery of the case. This joint, as will be further detailed, permanently affixes the molded base shell 24 to the peripheral edge of the lid shell 30. The base shell 24, as can be seen in the figures, is of a molded construction, preferably of an ABS plastic sheet formed into an open-topped parallelopiped container shape by a well known thermoforming process. The lid shell 30 on the other hand, while it includes some polymer panels or battens to stiffen its construction, is predominately a textile fabric construction with cloth panels sewn together to form the sides and various pockets as seen in FIG. 1, etc. The exterior of the case 10 further includes additional lengths of webbing material forming cinch straps 32 arrayed at right angles to the base-to-lid-shell joint. These straps 32 extend around to partially embrace the sides and preferably a portion of the back of the base shell (FIG. 2) and wrap around the lid shell of the case, extending between two (preferably three) pockets 34 protruding from the broad face of the lid shell. The buckle 38 that joins each pair of these right angled webbing straps can be used to cinch the lid portion and to hold the lid portion at a particular degree of expansion using a gusseted expansion joint 36 as will be detailed.

Figure 3:
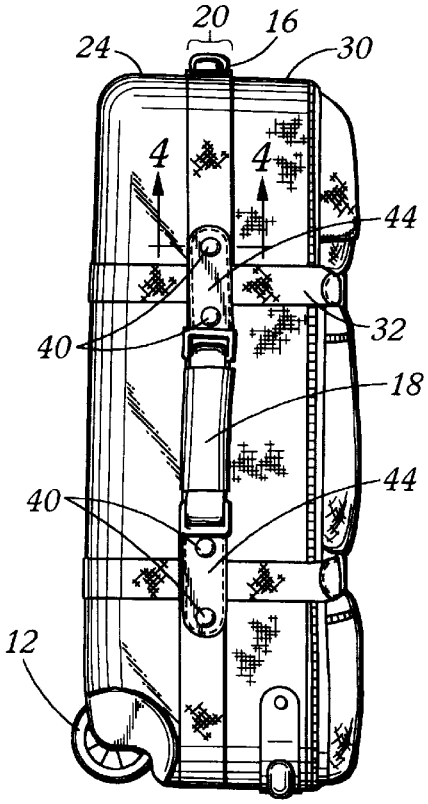
FIG. 3 shows a side view of the case, showing the overall view of the joint between the lid and base shell.
Figure 13:
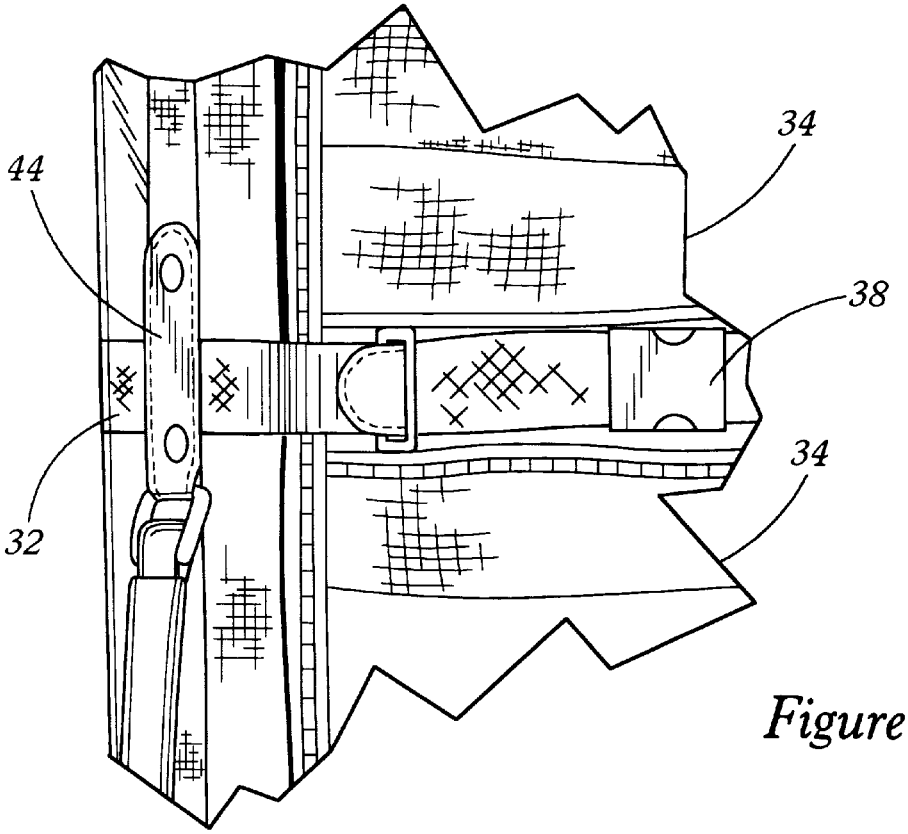
FIG. 13 shows a detail of a horizontal cinch strap as it crosses at right angles to the joint.

Referring to FIG. 3 in particular, these cinch straps form distinctive right angled constructions to the joint. Note also the inclusion of a carry handle 16, 18 directly in alignment with the webbing strap 22 defining the joint 20 between the lid and base shells. The carry handle is attached to the case using penetrating fasteners 40, the heads of which can be seen in FIG. 3. Note how the penetrating fasteners come in pairs and these pairs straddle the cinch straps. This same configuration is carried out on the opposite side of that shown in FIG. 3, the two sides forming mirror images with one another except, for the sake of economy, handle 18 is absent on the opposite side. FIG. 13 shows this arrangement in greater detail, and in addition shows the cinch buckle 38 of known construction used to engage each pair of cinch straps and hold the front panel in a non-expanded or a partially expanded condition.

Figure 4:
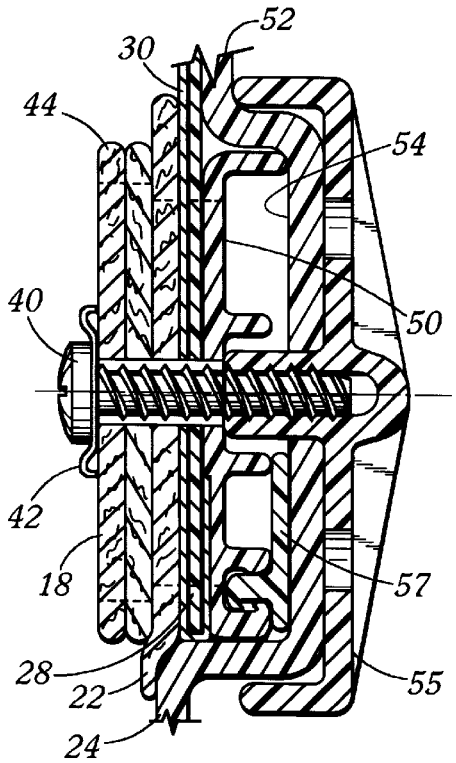
FIG. 4 shows a section through the joint as shown in 4—4 of FIG. 3.

Referring primarily to FIG. 4, the joint between the lid and base shell will now be detailed. FIG. 4 shows a partial cross section through one of auxiliary handle 18 at the location of the penetrating fastener. In detail, the cross section includes (reading from left to right) the slotted head of the penetrating fastener 40, washer 42, two layers of webbing constituting the attachment loop 44 for the auxiliary handle, the perimeter webbing strap 22, the textile part of the lid shell 30, the polymer stiffening layer 28, a first extrusion 50 sewn as shown to the above textile layers, the well portion of the anchor 55 protruding into one of the grooves formed in the first extrusion, a second extrusion 57 with its headed rib 64 engaged by the corresponding member 60 of the first extrusion, an outwardly facing open groove 54 molded into the peripheral edge portion 51 near the terminal edge 52 of the base shell 24, and anchor 55.

Figure 5:
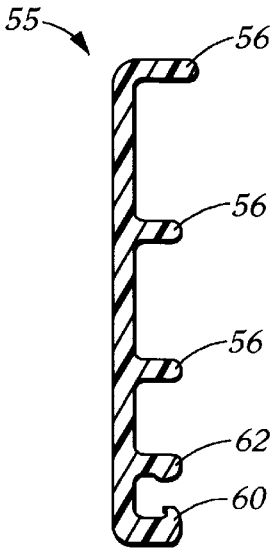
FIG. 5 shows the cross sectional shape of the first extrusion used in the joint shown in FIG. 4.
Figure 6:
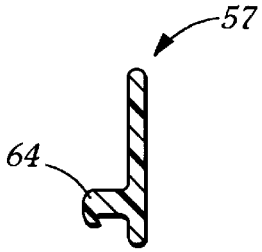
FIG. 6 shows another extrusion used in the joint of FIG. 4.
Figure 7:
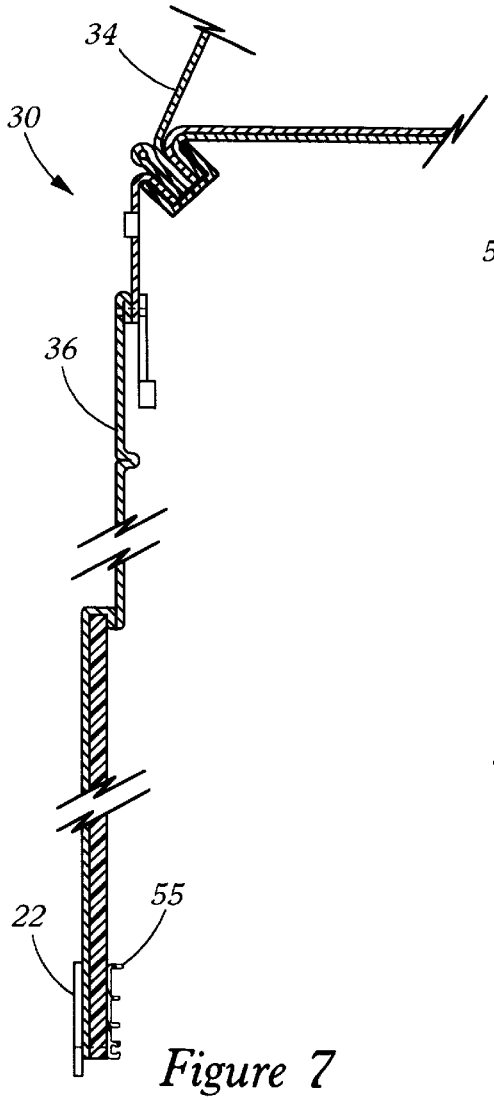
FIG. 7 shows an enlarged partial cross section of the lid portion near the joint with the base shell.

As indicated above, the elongated extrusion 50 is first attached to the peripheral edge portion along the edge of the fabric lid shell by sewing (see FIG. 7). In detail, the extrusion 55 is a relatively simple polyethylene member having a cross sectional shape as shown in FIG. 5, and includes upstanding ribs 56, and at least one headed rib 60 seen on the extreme bottom of FIG. 5, but also preferably includes an additional rib 62 which is used to position and back stop the corresponding headed rib 64 of the second extrusion 57 that is fixedly attached into the groove 54 of the base shell. This extrusion can be riveted, wire stitched or sewn along the edge of the base shell. Ribs 60, 62 and 64 extend around the entire perimeter of the shell. It is of course understood that these ribs can be interrupted or have gaps in them, as long as they, when interengaged, hold the base and lid shells in an adjustable relationship with one another, especially before the penetrating fasteners are used. These ribs, when pushed together to engage one another around the joint, will hold together so that the case can be moved and stored until the final fastening operations. It is preferred that the headed ribs engage one another such that the force required to push the ribs together, as shown in FIG. 4, is relatively small, but in contrast, the force to pry or remove the ribs from one another is relatively high. Applicants have found that ideally the localized force to push these ribs progressively together around the periphery of the joint should be in the range of 8 to 10 lbs. Such force can be easily applied by a skilled assembly person using ordinary hand pressure or perhaps by using a hand held roller. In contrast, it is found that the force required to pull the lid shell from the base shell, even before the penetrating fasteners secure the joint, is in the magnitude of 35 to 40 lbs. per lineal inch of the joint. However, the ribs can slide longitudinally relative to one another along their lengths fairly easily.

As can be seen, each of the extrusions that provide the upstanding ribs include an elongated web portion, especially member 55. This relatively wide web portion provides annular grooves between a series of spaced, upstanding additional ribs. As will be detailed with further reference to FIG. 4 and other figures, these annular grooves present spaces into which the penetrating fasteners 40 and mating anchors 55 may protrude and be located, thus spreading the forces involved in holding the lid and base shell together. The first length of webbing 22 is positioned directly opposite the extrusion 55. These are stitched together along their opposite edges. Note the stitching passes through an elongated strip of polyethylene stiffener material. This forms the rail portion of the lid of the case and gives a crisp, tailored look to the overall case. Immediately adjacent the poly stiffener 28 is a relatively wide textile gusset 36. This gusset permits the front panel of the lid of the case to move out a substantial distance away from the base shell to provide extra storage space should the user need this.

Figure 12:
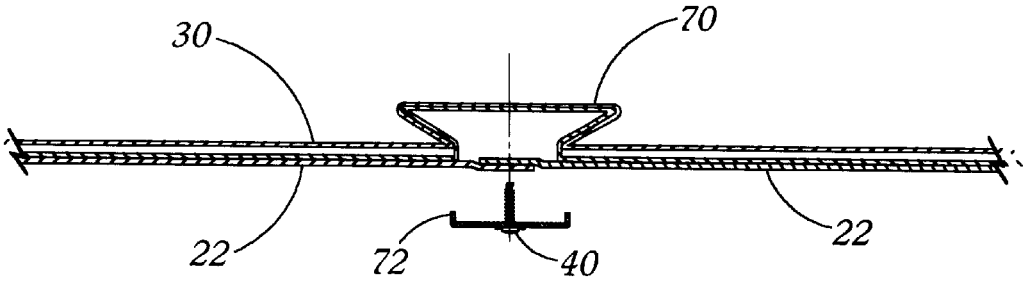
FIG. 12 shows a cross sectional view of the bottom of the case shown in FIG. 11.

As stated earlier, one of the main benefits of using the interengaging headed ribs to initially position the lid and base shell is to permit the two members to slide relative to one another and also tolerate a greater variation in circumference between the lid and base portions. In order to take advantage of this fully, the preferred embodiment includes a single textile gusset 70 arranged to extend perpendicular to the periphery of the joint 20. This is best seen in FIG. 12 which shows a cross section of that gusset which is normally positioned at the bottom of the case. This gusset is provided on one side thereof with a cover plate 72 which is attached to the peripheral edge portion of the lid shell by a penetrating fastener 40. After the assembly person engages the protruding ribs to form the joint as shown in FIG. 4, the tails of the perimeter webbing 22 are clinched taut. The webbing cinches the gusseted portion tight, matching precisely the enveloping perimeter dimension of the lid shell with the corresponding outer dimension of the base shell along its peripheral edge. Thereafter, penetrating fasteners are screwed through the webbing 22 at various locations and into corresponding anchors arrayed on the inside of the shell.

Figure 8:
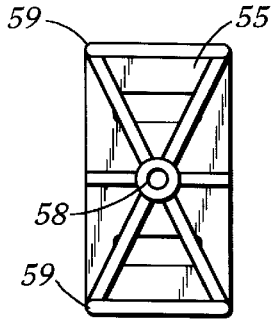
FIG. 8, FIG. 8A and FIG. 8B show a plan view and two cross sectional views of an anchor used in the joint construction.
Figure 8A:
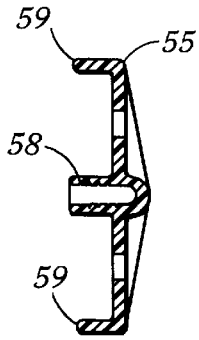
Figure 8B:
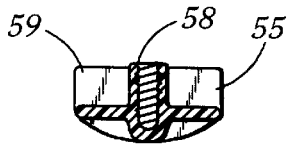
Figure 9:
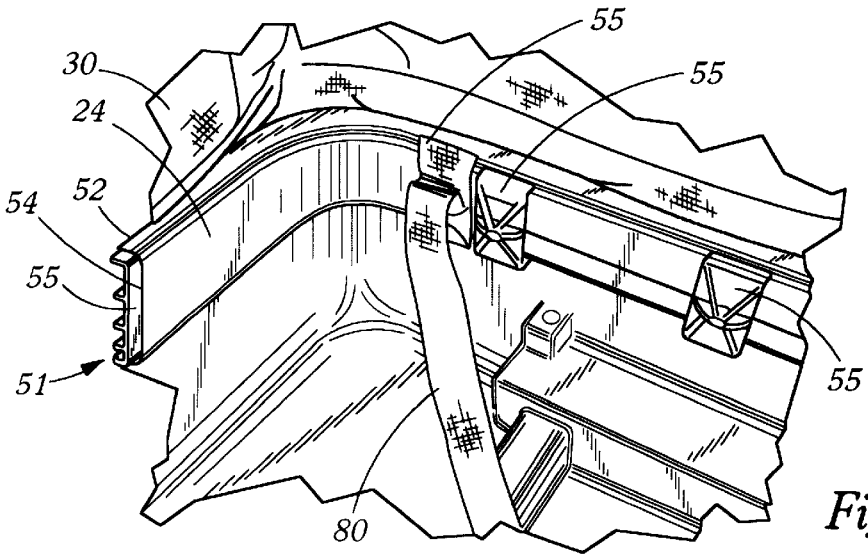
FIG. 9 is a perspective view of the interior of the luggage case showing the anchor being used in the joint.

Penetrating fasteners used to ultimately affix the lid and base shells together are ordinary screw type fasteners with self tapping threads of conventional fashion. The heads of such fasteners are shown in various figures including FIG. 1, etc. The pointed end of the fastener is received in the central cavity 58 of the anchor 55 shown in FIGS. 8, 8A, and 8B. The anchor also includes laterally extending wings 59 which position the anchor around the groove 54 and help keep it from rotating as the fastener is driven home from the outside of the case. Note also each of the positioning wings include a slot. This slot is used to receive a looped end of an elastic strap 80. This is shown in FIG. 9, where one of the winged anchors has been positioned to extend laterally across the peripheral edge portion of the base shell of the case.

Figure 10:
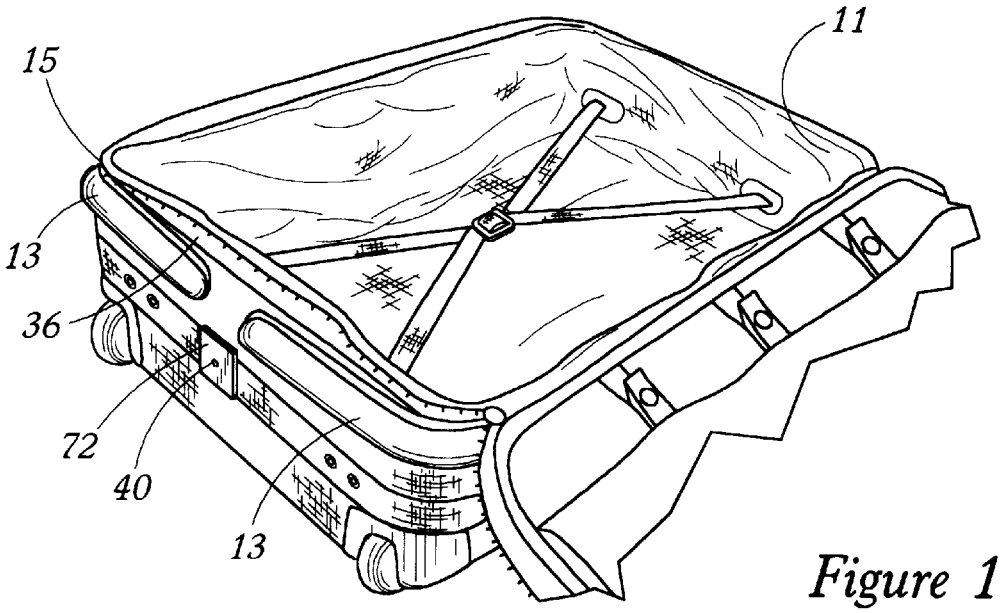
FIG. 10 is another interior view.
Figure 11:
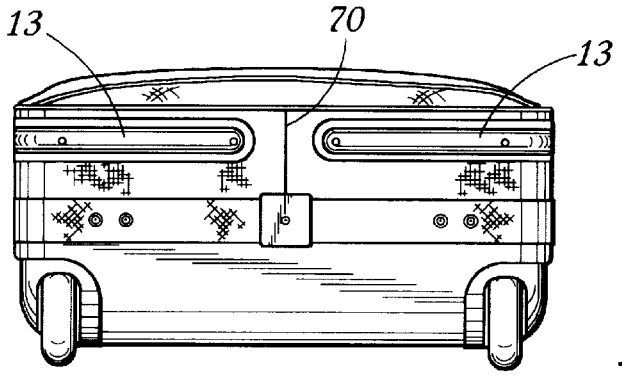
FIG. 11 is a detailed view of the bottom of the case.

FIG. 10 shows the interior of the case with an interior lining 11 zipped in as is conventional. Of course, it is to be understood that the penetrating fasteners and the anchors that receive their penetrating portions, and the other details, are now hidden beneath the textile lining 11. Note the plate used to terminate and adjust the peripheral dimension of the perimeter webbing is shown here, as well as the penetrating fastener used to hold the plate covering ends of the perimeter webbing. Immediately adjacent and opposite to the wheels are a pair of U-shaped glides 13 that are carried at the outermost edge of the poly stiffener portion of the textile lid shell 30. The perimeter slide fastener 15 is shown in the open position which permits ready access to the cavity formed by the base shell and the peripheral gusset 36.

Figure 2:
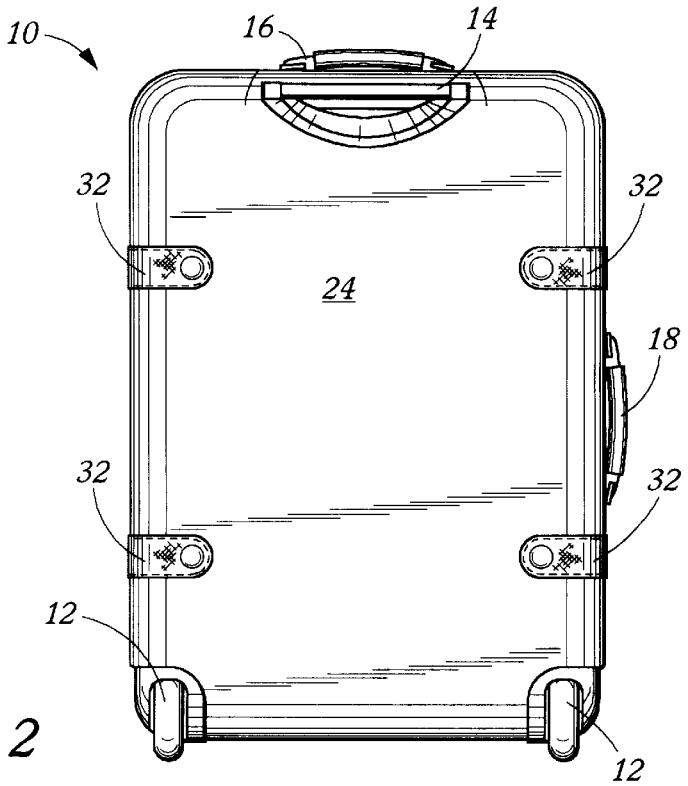
FIG. 2 shows the similar view showing the back or base shell of the preferred embodiment case.

Referring to FIG. 13, this detail view shows strap or webbing 32 in particular as an elongated webbing that extends perpendicularly to the webbing 22 and thus to the joint between the base shell and the fabric lid. The strap or webbing 32 is fastened to the shell well away from the joint 20, in particular by penetrating fasteners as shown in FIG. 2 on the back side of the case. This makes the attachment fairly secure as the strap 32 is specifically designed to take much of the load of the traveler's goods which tends to pull the lid away from the base. The straps 32 thus help resist so-called "bursting forces" which can cause failure of the joint 20 and other sewn seams in the fabric lid. Strap 32 is also adjustable using buckle 38 which permits the gusseted periphery (36 of FIG. 7) to adjustably expand to accommodate varying volumes of the user's goods. The strap 32 is advantageously arrayed around the girth of the luggage case by being positioned in the space between a pair of protruding pockets 34 on the main face of the fabric lid. The arrangement of strap 32 perpendicular to similarly configured strap or webbing 22 presents a distinctive look, but also functions to adjustably bind the luggage case together for a secure and versatile aid for carrying the traveler's things.

What is claimed is:

1. A luggage case having a body portion for containing a user's things, at least a pair of wheels and a wheel handle for towing the case on the wheels, the body portion comprising a base shell primarily formed of a relatively rigid, one-piece molded plastic with a bottom, the base shell having peripheral walls extending up from the bottom to define an interior volume to contain the user's things, the peripheral walls having a terminal edge and a peripheral edge portion along the terminal edge of the peripheral walls, and a lid shell affixed to the base shell, the lid shell being mostly formed of relatively flexible textile materials, and having a peripheral edge portion, means for permitting access to the interior volume, and means for affixing the peripheral edge portion of the lid shell to the peripheral edge of the base shell, the means for affixing comprising a first elongated extrusion initially sewn along a peripheral edge portion of the lid shell, an outwardly facing open groove formed along the terminal edge of the base shell sized to receive the first elongated extrusion.

2. A luggage case according to claim 1 wherein the means for affixing further comprising at least one flexible strap affixed at its ends to the peripheral walls of the base shell and extending around the lid shell, the flexible strap crossing at substantial right angles to the peripheral edge portion of the lid shell.

3. A luggage case according to claim 2 wherein said flexible strap includes a means for extending the length dimension of said strap to accommodate controlled expansion of the lid shell, for example when the user places more things in the interior volume.

4. A luggage case as set forth in claim 3 wherein said means for lengthening includes a buckle.

5. A luggage case as set forth in claim 3 wherein said flexible strap comprises primarily a length of webbing.

6. A luggage case as set forth in claim 3 wherein said lid shell includes at least a pair of protruding pockets with a space between said protruding pockets, said flexible strap passing from the base shell and through the space between the pair of protruding pockets.

7. A luggage case having a body portion for containing a user's things, at least a pair of wheels and a wheel handle for towing the case on the wheels, the body portion comprising a base shell primarily formed of a relatively rigid, one-piece molded plastic with a bottom, the base shell having peripheral walls extending up from the bottom to define an interior volume to contain the user's things, the peripheral walls having a terminal edge and a peripheral edge portion along the terminal edge of the peripheral walls, and a lid shell affixed to the base shell, the lid shell being mostly formed of relatively flexible textile materials, and having a peripheral edge portion and means for permitting access to the interior volume, and means for affixing the peripheral edge portion of the lid shell to the peripheral edge of the base shell, the means for affixing comprising a first elongated extrusion initially sewn along the peripheral edge portion of the lid shell, an outwardly facing open groove formed along the terminal edge of the base shell sized to receive the first elongated extrusion, wherein the first elongated extrusion includes a first headed bead extending there along, and the outwardly facing open groove includes a second headed bead sized to engage the first headed bead, the second bead being attached to the peripheral edge portion of the base shell, said means for affixing including fasteners passing through the peripheral edge portion of the base shell and through the first elongated extrusion.

8. A luggage case as set forth in claim 7 wherein the peripheral edge of the lid shell includes a length of webbing extending there along, the fasteners passing through the webbing.

9. A luggage case as set forth in claim 7 wherein the lid shell has a carrying handle thereon, the peripheral edge of the lid shell includes a length of webbing there along, the fasteners passing through the webbing.

10. A luggage case according to claim 7 wherein a second length of webbing wraps at least partially around a wall of the base shell and at least partially around the lid shell, the second length of webbing crossing at substantially right angles to the first length of webbing.

11. A luggage case having a body portion for containing a user's things, said luggage case having a general parallelopiped shape with sides, at least a pair of wheels and a wheel handle for towing the case on the wheels, the body portion comprising a base shell primarily formed of a relatively rigid, one-piece molded plastic with a bottom, the base shell having peripheral walls extending up from the bottom to define an interior volume to contain the user's things, the peripheral walls having a terminal edge and a peripheral edge portion along the terminal edge of the peripheral walls, and a lid shell affixed to the base shell, the lid shell being mostly formed of relatively flexible textile materials, and having a peripheral edge portion and means for permitting access to the interior volume, means for affixing the peripheral edge portion of the lid shell to the peripheral edge of the base shell, and a generally U-shaped glide means extending along a side of the luggage case adjacent said at least pair of wheels and parallel with said terminal edge and along at least a portion of two adjacent sides.

12. A luggage case as set forth in claim 11, wherein said lid shell includes a stiffening member having an outermost edge, and said U-shaped glide means being attached to the stiffening polymer layer along said outermost edge.

* * * * *